US008539801B2

(12) United States Patent
Calleberg

(10) Patent No.: US 8,539,801 B2
(45) Date of Patent: Sep. 24, 2013

(54) HANDLE DEVICE

(75) Inventor: Johan Calleberg, Goteborg (SE)

(73) Assignee: ASSA OEM AB, Eskilstuna (SE)

( * ) Notice: Subject to any disclaimer, the term of this patent is extended or adjusted under 35 U.S.C. 154(b) by 2 days.

(21) Appl. No.: 12/747,640

(22) PCT Filed: Dec. 18, 2008

(86) PCT No.: PCT/SE2008/051506

§ 371 (c)(1),
(2), (4) Date: Jun. 11, 2010

(87) PCT Pub. No.: WO2009/078800

PCT Pub. Date: Jun. 25, 2009

(65) Prior Publication Data

US 2010/0263419 A1 Oct. 21, 2010

(30) Foreign Application Priority Data

Dec. 18, 2007 (SA) ..... 0702814

(51) Int. Cl.
*E05B 13/10* (2006.01)

(52) U.S. Cl.
USPC ..... 70/222; 70/216; 70/472

(58) Field of Classification Search
USPC ..... 70/207, 209, 215–218, 221–223, 70/472
See application file for complete search history.

(56) References Cited

U.S. PATENT DOCUMENTS

| | | | | |
|---|---|---|---|---|
| 3,096,114 | A * | 7/1963 | Trammell, Jr. | 70/218 |
| 3,808,850 | A * | 5/1974 | Walters | 70/215 |
| 5,388,434 | A * | 2/1995 | Kalis | 70/58 |
| 5,651,280 | A * | 7/1997 | Park | 70/472 |
| 5,787,743 | A * | 8/1998 | Weigard | 70/422 |
| 6,178,789 | B1 * | 1/2001 | Finkelstein et al. | 70/210 |
| 6,297,725 | B1 * | 10/2001 | Tischendorf et al. | 70/278.1 |
| 6,546,765 | B1 * | 4/2003 | Linares | 70/210 |
| 6,868,703 | B2 * | 3/2005 | Molzer | 70/210 |
| 7,275,402 | B2 * | 10/2007 | Luling et al. | 70/472 |
| 8,011,217 | B2 * | 9/2011 | Marschalek et al. | 70/473 |

FOREIGN PATENT DOCUMENTS

| | | |
|---|---|---|
| EP | 0861959 A2 | 9/1998 |
| FR | 2866045 A1 | 8/2005 |
| GB | 2279132 A | 12/1994 |

* cited by examiner

*Primary Examiner* — Christopher Boswell
(74) *Attorney, Agent, or Firm* — Holland & Hart LLP; Bryan G. Pratt

(57) ABSTRACT

Handle device for operating doors, windows and the like, comprising a first element, which is rotatable about an axis of rotation, a second element, and a coupling device which is connected to the first and the second element and is designed to selectively allow or prevent relative rotation about the axis of rotation between the first and the second element, the coupling device comprising an outer coupling member (3, 50) and an inner coupling member (5, 31), which is concentrically accommodated, rotatable about the axis of rotation, in the outer coupling member. The handle device comprises at least one engaging member (20), which is radially displaceable in the inner coupling member (5, 31), and an activating member (12, 60) which is accommodated in the inner coupling member and axially displaceable therein, parallel to the axis of rotation. The engaging member and the activating member have interacting contact surfaces (12*b*, 12*c*, 61, 63) in order, during axial displacement of the activating member, to press the engaging member into a radially projecting position for simultaneous engagement with the inner and outer coupling member.

15 Claims, 3 Drawing Sheets

Fig. 2
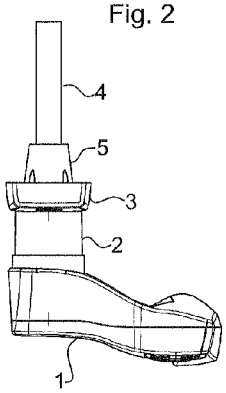
Fig. 1
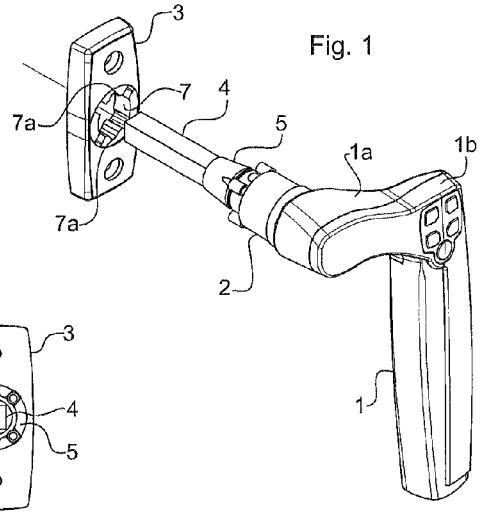
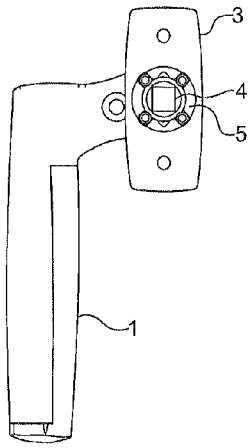
Fig. 3
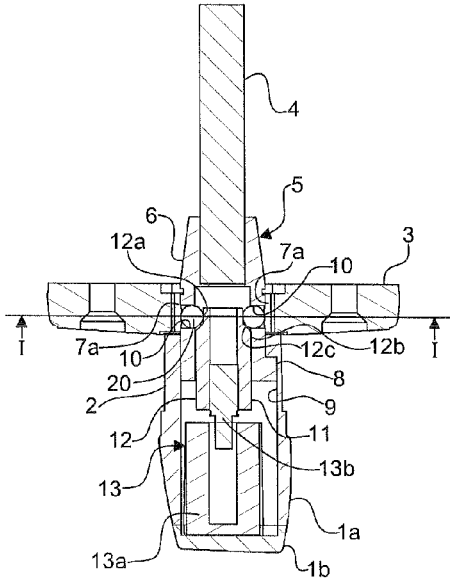
Fig. 4a
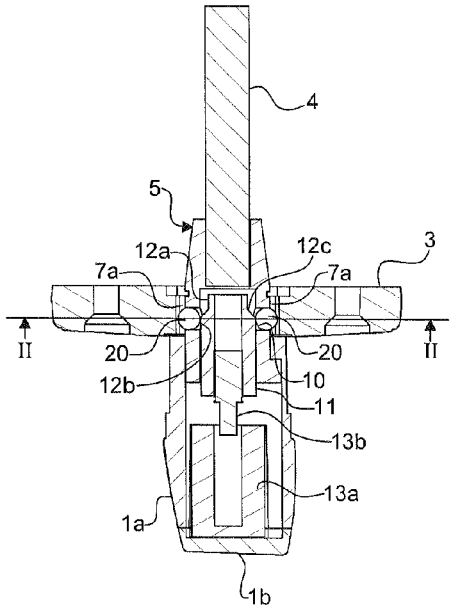
Fig. 4b Fig. 6
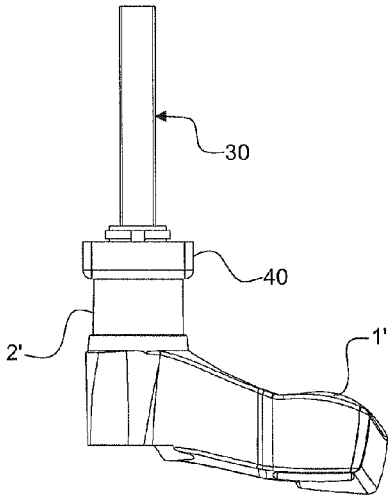
Fig. 5
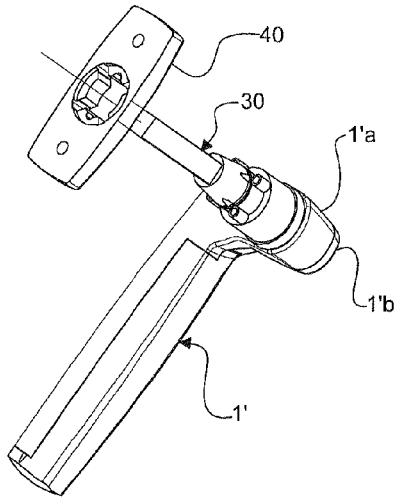
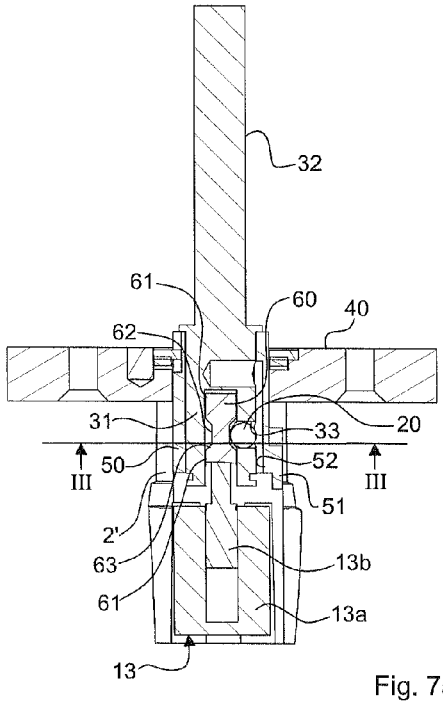
Fig. 7a
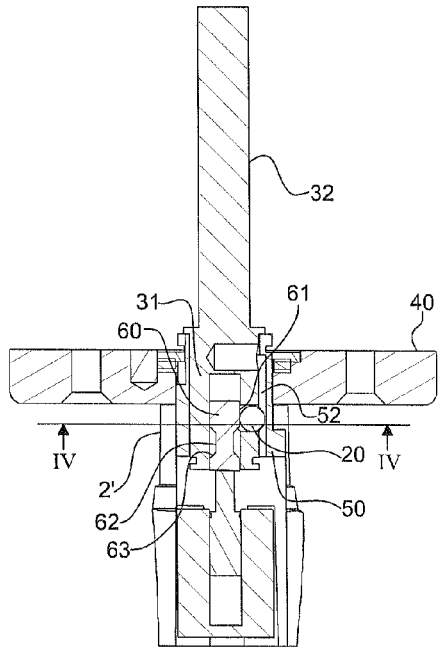
Fig. 7b Fig. 8a
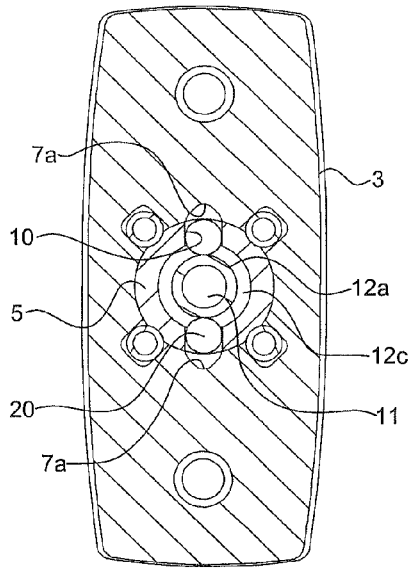
Fig. 8b
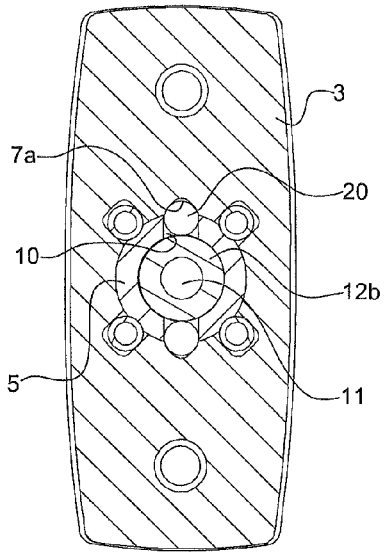
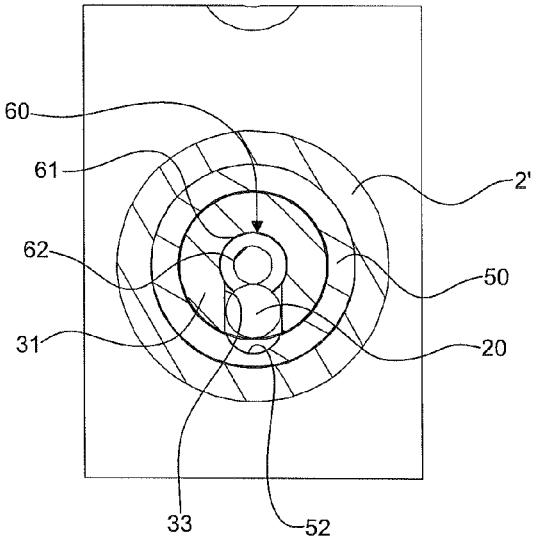
Fig. 9a
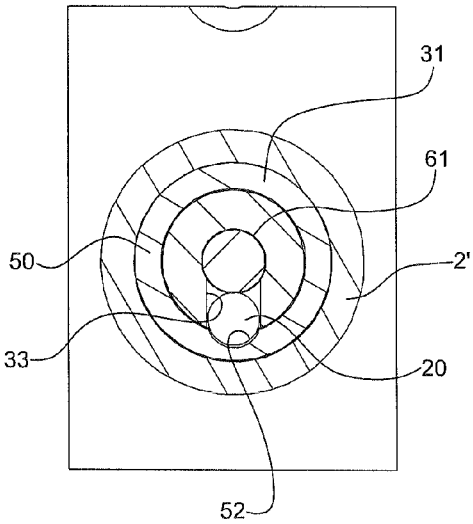
Fig. 9b

HANDLE DEVICE

FIELD OF THE INVENTION

The invention relates in general to a handle device for operating doors, windows, gates, hatches and the like. The invention relates in particular to such a handle device comprising a first element which is rotatable about an axis of rotation, a second element, and a coupling device for selectively allowing or preventing relative rotation about the axis of rotation between the first and the second element.

BACKGROUND OF THE INVENTION

In the case of many doors, windows and other such elements provided with a rotatable handle, it is desirable to be able to selectively couple a part that can be turned or rotated by means of the handle to another part, or to disengage it therefrom. The other part may consist either of a similarly rotatable part or of a fixed part.

Where both of the parts are rotatable, it may be desirable in a disengaged state, for example, to allow the handle to be turned without affecting the other part and in a coupled state to allow a rotational movement of the handle to be transmitted to the other part. The other part may then consist, for example of a swivel pin, such as a handle shank, which is in turn capable of transmitting the rotational movement to a tumbler, a bolt, an espagnolette bolt, a lock or some other device for influencing the state of the door or the window. In the coupled position, operation therefore occurs in the normal way by means of the handle. In the disengaged position, on the other hand, the state of the door or window remains unaffected if the handle is turned. Such selective disengagement may be used, for example, as a child safeguard, in order to prevent an external door or a window being opened from the inside or in order to prevent damage to a lock or the like coupled to the handle if excessive forces are applied to the handle when the lock is in the locked position.

Where the second part consists of a fixed, non-rotatable part, the rotatable handle can be conventionally fixed or continuously coupled by means of a handle shank to a bolt, an espagnolette bolt, or a lock, for example, or some other device for influencing the state of the door or the window. Disengagement and coupling between the rotatable handle and the fixed part can then be used, in the disengaged position, to allow operation and, in the coupled position, to lock the handle and thereby prevent operation of the door or the window. The coupling between the handle and the fixed part can in this respect be said to constitute a lock. Such selective disengagement and coupling between the rotatable handle and the fixed part can be used as a child safeguard, for example, or in order to prevent unauthorized operation of a door or a window.

In both cases the disengagement and coupling between the rotatable handle and the other part can be achieved manually, for example by operating a mechanical button, a lock cylinder or the like. Recently, however, it has become increasingly more common to bring about such a disengagement and coupling by electromechanical means. This allows disengagement and/or coupling, for example, only if an authorized user has first entered a code via a keypad or entered an identification via an electronic card reader.

PRIOR ART

EP 0 861 959 B1 shows a device which allows selective disengagement and coupling between a rotatable handle and a likewise rotatable square shank, which is coupled to a lock. The device comprises two concentric tubes, which are coupled to the handle and the square shank respectively. The tubes each have a hole in their walls. A radially displaceable pin is arranged in the inner tube. By means of a spring, which is supported against the inner tube, the pin can be shot out through the two holes, thereby coupling these together. A depressor element is arranged radially outside the two tubes. In order to disengage them, the depressor element is made, by means of a pivoted arm driven by a motor, to press the pin radially inwards, so that it is no longer engaged in the hole through the outer tube. This device is not only relatively complicated with many moving parts, but takes up a lot of space and furthermore requires the assembly of a relatively large handle escutcheon or handle plate, which encloses necessary parts required for the disengagement. A further disadvantage with this device is that disengagement can only take place once both of the tubes have assumed a predefined rotational position, in which the pin is aligned with the depressor element.

In order to achieve selective disengagement and coupling of a rotatable handle and a fixed part, the prior art encompasses devices which work on two different basic principles. A known handle device comprises a rotatable handle which is rotatably fixed to a handle escutcheon or handle plate, which can be fixed to a door, a window or the like. A handle spindle or handle shank, usually in the form of a square shank, is rotationally fixed to the handle. In order to lock the handle, the latter comprises a pin, which is axially displaceable parallel to the axis of rotation of the handle and which in a projecting position engages in a corresponding hole in the handle escutcheon. The pin is operated, for example, by a pushbutton or a pressure cylinder for a key. Another known device which works on the second basic principle also comprises a handle which is rotatable relative to a handle escutcheon and a handle shank, which is fixed to the handle. For locking the handle, the handle escutcheon comprises a turning cylinder for a key, the turning cylinder interacting with a pin, radially displaceable in the handle escutcheon relative to the axis of rotation of the handle. The pin can be brought into locking engagement with a recess in the handle or square shank by means of the turning cylinder.

In both of these devices for achieving selective disengagement and coupling between a rotatable handle and a fixed part, a relatively big pin taking up a lot of space is needed in order to achieve a satisfactory locking of the handle. A further disadvantage with both these solutions is that they are unsuited to electrical control of the disengagement and coupling.

SUMMARY OF THE INVENTION

An object of the invention is therefore to provide an improved handle device which allows selective disengagement and coupling between a first rotatable element and a second element.

Another object is to provide such a device which is simple with few moving parts, which is compact and which also allows a very solid coupling between the two elements.

A further object is to provide such a device which readily allows disengagement and coupling from either side or both sides of a door, a window or the like to which the device is fitted.

Yet another object is to provide such a device which facilitates electrical control of the disengagement and coupling.

Yet a further object is to provide such a device in which all components for controlling the disengagement and coupling, whether this is done mechanically or electrically, can be located in the handle grip.

These and other objects are achieved by a handle device of the type specified in the introductory part of claim 1 and which has the special technical features specified in the characterizing part. The handle device according to the invention is suitable for operating doors, windows and the like. The handle device comprises a first element which is rotatable about an axis of rotation, a second element, and a coupling device which is connected to the first and the second element and is designed to selectively allow or prevent relative rotation about the axis of rotation between the first and the second element. The coupling device comprises an outer coupling member and an inner coupling member, which is concentrically accommodated, rotatable about the axis of rotation, in the outer coupling member. At least one engaging member is radially displaceable in the inner coupling member. An activating member is accommodated in the inner coupling member and axially displaceable therein, parallel to the axis of rotation.

The engaging member and the activating member have interacting contact surfaces in order, during the axial displacement of the activating member, to press the engaging member into a radially projecting position for simultaneous engagement with the inner and outer coupling member.

The handle device according to the invention allows selective disengagement and coupling between the first and the second element. The first element may comprise a part of the handle or be rotationally fixed thereto, the invention therefore allowing selective disengagement and coupling between the handle and the second element. The other element may be rotatable or non-rotatable. The engaging member may assume a retracted position, in which it does not engage with the outer coupling member. In this position relative rotation is therefore allowed between the inner and outer coupling members and hence between the first and second elements. Displacement of the axially moveable activating member allows the engaging member to be pressed radially outwards, so that it engages with both the inner and the outer coupling members, thereby achieving a coupling of these two members and hence of the first and second element. The device according to the invention affords a very compact embodiment of the coupling device with few moving parts. The axially moveable activating member means that control of the selective disengagement and coupling can readily be achieved from a handle which is located on either side of the door or the window to which the device is fitted. The coupling device with the interacting, axially moveable activating member and radially moveable engaging member means that only a slight force needs to be applied to the activating member in order to achieve the coupling between the two elements. A further advantage is that it is possible to obtain the requisite radial projection of the engaging member with only a short axial movement of the activating member. The stroke length of the activating member can therefore be kept small. The axial movement can therefore advantageously be achieved with a relatively small and energy-saving electrical activator, such as a solenoid, a motor or a piezo-electric activator. If so desired, such a small and energy-saving electric activator can be located in the handle together with an adequate power source, without the need to make this larger than is otherwise usual. In reality the invention means that all parts and components for allowing an electrically controlled selective disengagement and coupling of desired elements can be accommodated in a handle of normal size. The axially displaceable activating member moreover means that a selective disengagement and coupling of a handle with a desired element located on one side of a door or a window can readily be controlled by electrical components which are located exclusively in a handle located on the other side of the door.

The engaging member may advantageously comprise a ball, which is received in a radial, cylindrical hole in the inner coupling member. Alternatively the engaging member may comprise a circular cylindrical pin, which is located in a recess in the inner coupling member, so that its axis extends parallel to the axis of rotation. Regardless of the embodiment of the engaging members, the handle device may comprise more than one engaging member.

The outer coupling member suitably comprises a substantially circular cylindrical bore, in which the inner coupling member is received and in the circumferential surface of which a radially curved and axially elongated groove is located. The radially curved shape of the groove interacts with the spherical or cylindrical shape of the engaging member in order to press the engaging member back into its retracted position when the activating member is in a position that allows this and when a torsional moment is applied to either the inner or outer coupling member. This obviates the need for any spring device or the like for returning the engaging member to the disengaged position when the activating member is situated in a corresponding position.

If the inner coupling element is fixed to the handle and the outer coupling member is fixed to or consists of a handle escutcheon, the handle device readily allows immobilization or locking of the handle. The strong, solid coupling achieved between the inner and the outer coupling member means that such an immobilization of the handle can for many applications constitute full locking of a door or a window, for example.

The handle device can also be designed to allow selective disengagement and coupling between two rotatable parts, this type of selective coupling sometimes being known as free swivelling. In order to achieve such a selective coupling, the inner coupling member is suitably fixed to or consists of a rotatable swivel pin and the outer coupling member is suitably fixed to the handle.

In order to allow a reliable and smooth-running transmission of movement with low friction, the activating member suitably has a surface inclined in its axial displacement direction, which in contact with the engaging member presses this radially outwards when the activating member is displaced axially.

The handle device may comprise means for manual actuation of the activating member.

Owing to its smooth running and compactness, however, the handle device is even better suited to electrical control and therefore comprises suitable means for electrically acting upon the activating member. These means may comprise an electric motor or preferably a solenoid, which is designed to produce axial displacement of the activating member.

In the case of such electrical control, the handle device also suitably comprises an electrical control circuit for controlling the means of electrically acting upon the activating member and a keypad which is electrically connected to the control circuit. In this embodiment the selective disengagement and/or coupling can be achieved only after entering a correct authorization code. The electrical control circuit can additionally or alternatively be connected to an electronic card reader or some other similar authorization-verifying equipment. Again, the effective coupling device, by means of which an axial movement of the activating member can be translated by a slight force into a radial engaging movement of the engaging member, means that all parts and components for such authorization verification and electrical control of the device can be accommodated in a handle. This handle may be either the handle, coupling of which to another element is being controlled, or also the second of two handles fitted to a door or the like.

Further objects and advantages of the invention are set forth in the following description of exemplary embodiments, and in the patent claims.

BRIEF DESCRIPTION OF THE DRAWINGS

There follows a detailed description of exemplary embodiments, referring to the drawings attached, in which:

FIG. 1 is a schematic perspective view of a partially disassembled handle device according to a first embodiment of the invention.

FIG. 2 is a rear plan view of the handle device shown in FIG. 1 when this is assembled.

FIG. 3 is a plan view from above of the handle device shown in FIG. 3.

FIGS. 4*a* and 4*b* show schematic sections through the handle device shown in FIGS. 2 and 3 when this is in a disengaged and a coupled state respectively.

FIG. 5 is a schematic perspective view of a partially disassembled handle device according to a second embodiment of the invention.

FIG. 6 is a plan view from above of the handle device shown in FIG. 1 when this is assembled.

FIGS. 7*a* and 7*b* show schematic sections through the handle device shown in FIG. 6 when this is in a disengaged and a coupled state respectively.

FIG. 8*a* is a schematic section along the line I-I in FIG. 4*a*.

FIG. 8*b* is a schematic section along the line II-II in FIG. 4*b*.

FIG. 9*a* is a schematic section along the line in FIG. 7*a*.

FIG. 9*b* is a schematic section along the line IV-IV in FIG. 7*b*.

DETAILED DESCRIPTION OF EXEMPLARY EMBODIMENTS

FIGS. 1, 2, 3, 4*a*, 4*b*, 8*a* and 8*b* show a handle device according to a first embodiment of the invention. This handle device is designed to allow selective disengagement and coupling between the handle grip and a fixed part. In the disengaged position, rotation of the handle grip is therefore allowed and in the coupled position the handle grip is prevented from being turned.

The handle device comprises a handle grip 1, a handle neck 2, a handle escutcheon 3 or plate and a swivel pin or handle spindle 4 in the form of a square shank.

The handle escutcheon 3 comprises fixing holes for receiving screws or the like, by means of which it can be fixed to a door, a window, a gate, a hatch (not shown) or a similar element. The handle escutcheon 3 further comprises a central through-hole 7, the central axis of which defines an axis of rotation for the handle grip. Two opposing grooves 7*a* are made in the central hole 7 of the handle escutcheon 3. The grooves 7*a* are formed as axially running, radial, outwardly curved recesses in the circumferential surface of the central hole 7.

A boss 5 is received in the handle neck 2. In the embodiment shown in FIGS. 1-4*b* and 8*a*-*b* the boss 5 consists of an inner coupling member for achieving a selective disengagement and coupling of the handle grip 1 in relation to the handle escutcheon 3. For fitting the boss 5 in the handle neck 2, the handle grip 1 comprises two separable parts 1*a*, 1*b*. Detaching the part 1*b* from the part 1*a* gives access to the internal cavity in the handle neck 2, so that the boss 5 can be threaded into the neck from the side of the handle grip 1 remote from the handle escutcheon 3. The boss 5 has a part 6 projecting from the handle neck and extending through the hole passing through the handle escutcheon 3. The boss 5 comprises a radially projecting pin 8, which is received in a corresponding inner groove 9 in the internal cavity of the handle neck 2. The engagement of the pin 8 in the groove 9 prevents relative rotation between the boss and the handle neck 2. In the part of the boss 5 projecting from the handle neck 2 is an axial square hole, in which the handle spindle 4 is received. The longitudinal axis of the handle spindle 4 defines an axis of rotation, about which the handle grip 1 is rotatable relative to the handle escutcheon 3.

The boss 5 furthermore has two opposing radial, cylindrical through-holes 10. Each of these holes 10 receives an engaging member in form of a ball 20. An axially displaceable activating member 11 is arranged inside the boss 5. The activating member is rotationally symmetrical and has a front cylindrical section 12*a* with a smaller diameter, a rear cylindrical section 12*b* with a larger diameter and an intermediate conical section 12*c*. In the embodiment shown the conical section has a cone angle of 45°. The conical section 12*c* forms an outer curved surface which is inclined in the axial direction of movement of the activating member 11. For driving the activating member 11, an electrically powered solenoid 13 is arranged in the handle grip 1. The solenoid comprises a fixed part 13*a* and a part 13*b* axially moveable in relation to the fixed part. The moveable part 13*b* is fixed to the activating member 11. Delivering a current pulse to the fixed part of the solenoid enables the moveable part 13*b* to be moved axially in either direction.

In the position shown in FIGS. 4*a* and 8*a*, the moveable part 13*b* of the solenoid and hence the activating member 11 are in a retracted position. The front cylindrical section 12*a* of the activating member 11 is situated directly in front of the balls 20. The distance between the outer surface of the cylindrical section 12*a* and the outer surface of the boss 5 around the hole 10 is substantially equal to the diameter of the balls 20. In this position, therefore, the balls are allowed to assume a position in which they do not protrude from the boss 5. The boss 5 is therefore allowed to rotate inside the handle escutcheon 3, so that the handle grip is released and can be freely turned in relation to the handle escutcheon 3. In this position the handle grip can therefore be used normally in order to transmit a rotational movement to a tumbler, an espagnolette bolt or some other member via the handle spindle 4 in the usual way.

When the handle grip 1 is to be locked, it is first turned into a position in which the two balls 20 align with the two opposing grooves 7*a* in the handle escutcheon 3. It will be appreciated that the handle grip can therefore be locked in two rotational positions with an 180° offset. The solenoid 13 is then supplied with a current pulse, thereby displacing the moveable part 13*b* thereof axially outwards from the fixed part 13*a*. The activating member 11 is thereby also displaced to the position shown in FIGS. 4*b* and 8*b*. In the course of this axial displacement movement, the conical surface 12*c* of the activating member in contact with the balls 20 will press these radially outwards, so that they are received in and engage with the grooves 7*a* in the handle escutcheon 3, which in this exemplary embodiment constitutes an outer coupling member. When the engaging member 11 has assumed the full axially projecting position shown in FIGS. 4*b* and 8*b*, the balls 20 will be supported against and held in the radially projecting position by the cylindrical surface 12 of the activating member having a larger diameter. The balls 20 hereby engage simultaneously in the holes 10 and the grooves 7*a*, thereby preventing rotation of the boss 5 and hence the handle neck 2 and the handle grip 1.

When the handle grip is to be disengaged again, the solenoid 13 is supplied with a current pulse, which causes the moveable part 13*b* and thereby the activating member 11 to be displaced to the retracted position shown in FIGS. 4*a* and 8*a*. The part 12*a* of the activating member 11 with a smaller diameter will thereby come to lie directly in front of the holes 10, so that the balls 20 are allowed to assume the retracted position not protruding from the activating member 11. This retracting movement of the balls can be achieved entirely without the action of any spring device or the like. Instead, the balls are brought into their seated position in the holes 10 not protruding from the activating member in that the spherical surface of the balls 20 interacts with the radially curved surface of the grooves 7*a*, since the handle grip is being turned when the balls are not locked by the part 12*b* of the activating member having a larger diameter.

As can be seen from FIG. 1, the handle grip 1 is provided with a keypad. In the handle grip 1 there is also an electronic control circuit (not shown) and a battery (not shown) for powering the control circuit and the solenoid 13. The electronic control circuit is designed to emit a current pulse adjusting the state of the solenoid only if a correct authorization code has first been entered via the keypad. In this way the handle device shown in FIGS. 1-4*b* and 8*a*-*b* can be used as a lock for the door or the window in which it is arranged.

FIGS. 5, 6, 7*a*-*b* and 9*a*-*b* show a second embodiment of the handle device according to the invention. In the further description, the parts corresponding to those in the embodiment described above will be given the same reference numerals as above. With this second embodiment it is possible to achieve selective disengagement and coupling between the handle grip 1 and a rotatably moveable part. In the example shown this rotatably moveable part consists of handle spindle 30. The handle spindle 30 is capable of transmitting a rotational movement to a tumbler, an espagnolette bolt (not shown) or some other member in the usual way.

Among other things, this embodiment differs from that described above in that the handle spindle 30 comprises a circular cylindrical end section 31, which is firmly connected to a square shank 32. The end section 31 is rotatably accommodated in a boss 50, which is in turn received in the handle neck 2'.

As in the embodiment described above, the boss 50 can be introduced into the handle neck 2' when a part 1'*b* of the handle grip 1' is released from another part 1'*a* of the handle grip. The boss 50 comprises a radially projecting pin 51, which is received in a corresponding groove 9 in the handle neck 2'. The boss 50 is therefore prevented from turning in relation to the handle neck 2' and the handle grip 1'. The boss 50 has a central axial through-bore, in the circumferential surface of which a radial, outwardly curved groove 52 is arranged, extending axially parallel to the bore. According to this embodiment the boss 50 constitutes an outer coupling member.

The circular cylindrical end section 31 of the handle spindle is concentrically received in the axial bore of the boss 50 and constitutes an inner coupling member. The end section 31 has a radially extending circular cylindrical hole 33, in which a ball 20 is displaceably seated. The end section 31 also has a central circular cylindrical recess, in which an axially displaceable activating member 60 is located.

The activating member 60 comprises two sections 61 having a larger diameter and a waist section 62 of smaller diameter located between them. Conical sections 63 having a cone angle of 45° are located between the waist section 62 and the two sections 61. The activating member 60 is firmly connected to a moveable part 13*b* of a solenoid 13, which also comprises a fixed part 13*a*.

In the position shown in FIGS. 7*a* and 9*a* the moveable part 13*b* of the solenoid and hence the activating member 60 are in a projecting position in relation to the fixed part 13*a* of the solenoid. The activating member 60 is here situated in a position in which the waist section 62 is directly in front of the hole 33 in the end section 31 of the handle spindle. The distance between the surface of the waist section 62 and the outer surface of the end section 31 around the hole 33 is substantially equal to the diameter of the ball, so that the ball 20, which rests against the waist section, is situated in a position not projecting radially from the end section 31. Under the rotation of the handle grip 1', the handle neck 2' and the boss 50 also turn. On the other hand, the rotational movement is not transmitted to the handle spindle 30 in this position of the activating member 60 and the ball 20. The handle grip 1' is therefore disengaged from the handle spindle 30 and in this position is therefore allowed to turn freely in relation to the handle spindle 30, thereby affording a so-called free-swivelling function. In this position it is therefore not possible, by means of the handle grip 1', to operate a tumbler, an espagnolette bolt or any other device to which the square shank 32 of the handle spindle 30 may be coupled.

In order to couple the handle grip 1' to the handle spindle 30, the handle grip is first turned to a position in which the groove 52 is aligned with the hole 33. It will be appreciated that this relative position between the boss 50 and the handle spindle 30 can be assumed regardless of which rotational position these two parts occupy in relation to the handle escutcheon 40. As in the embodiment described above, the solenoid 13 is then supplied with a current pulse, which causes the moveable part 13*b* to be displaced towards the fixed part 13*a*. The activating member 60 is thereby displaced towards the solenoid 13, so that the upper conical surface 62 in FIG. 7*a*, in contact with the ball 20, presses the ball radially outwards in the hole 33 until it comes into engagement with the groove 52 in the boss 50. The ball 20 is then in simultaneous engagement with the boss 50 and with the end section 31 of the handle spindle 30, so that a rotational movement which is imparted to the handle grip 1' is transmitted to the handle spindle 30, via the boss 50 with its pin 51 and its groove 52, the ball 20 and the end section 31 of the handle spindle 30 with its hole 33. In this way the handle grip 1', in the position shown in FIGS. 7*b* and 9*b*, is coupled to the handle spindle 30 and can therefore be used to operate a tumbler, an espagnolette bolt or some other member or device to which the handle spindle 30 is coupled.

As in the embodiment demonstrated with reference to FIGS. 1-4, no spring or the like is needed in order to return the ball 20 to its retracted position not projecting radially from the end section 31. Such a return movement of the ball is instead achieved through the interaction between the spherical surface of the balls 20 and the outwardly curved surface of the groove 52. In the embodiment shown in FIGS. 5-7 and 9 the solenoid 13 can also be controlled by an electric control circuit (not shown), to which a keypad (not shown) and a battery (not shown) may be connected. All of these parts can be accommodated in the handle grip.

An advantage of the handle device according to the invention is that it requires only a very slight force in order to produce the axial movement of the activating member, the axial movement bringing the engaging member in the form of a ball into or out of engagement in order to achieve coupling or disengagement. A further advantage is that the activating member only requires a very small stroke length. In an embodiment in which the ball has a diameter of 4 mm, and the inclined or conical surface of the activating member that comes to bear against the ball in transmitting movement has an angle of 45° to the direction of movement of the activating member, a stroke length of 2.1 mm is sufficient to displace the ball between its respective coupled and disengaged positions. Both of these advantages mean that the drive and control members can be made very compact, so that they can in this way be accommodated in a handle grip of conventional dimensions.

Exemplary embodiments of the invention have been described above. It will be appreciated, however, that the invention is not limited to these embodiments but can be modified without departing from the scope of the following patent claims. For example, the axially displaceable activating member, instead of being powered by an electrical solenoid, may be coupled to a mechanical pushbutton or some other mechanical member for manually operating the activating member. Such a mechanical member is advantageously arranged in the handle grip, preferably axially in line with the direction of movement of the activating member.

The solenoid forming part of the embodiments described above may comprise a permanent magnet (not shown), which is designed to draw the moveable part into the retracted position shown in FIGS. 4*a* and 7*b*. The solenoid may also be provided with a spring (not shown), which is designed to displace the moveable part to the projecting position shown in FIGS. 4*b* and 7*a*. Such a magnet and spring provide a bistable solenoid, in which the moveable part maintains an assumed retracted or projecting position without the need for a continuous supply of current to the solenoid. In such an embodiment it is therefore sufficient to supply a brief current pulse to the solenoid when it is to switch between its two possible positions. This affords a very energy-saving device, which in turn helps in allowing the use of a small battery, which can advantageously be accommodated in the handle grip. Instead of using a solenoid to electrically bring about axial movement of the activating member, it is also possible to use an electric motor, a piezo-electric member or some other device capable of electrically powering an axial movement. Instead of an authorization-verifying keypad, which is connected to the control circuit for controlling the movement of the activating member, other equipment may be used in order to verify a user's authorization. Examples of such equipment are so-called RFID equipment, which by radio transmission can read off a coded identification card or a coded identification badge or the like, which a user holds up close to an RFID reader that may preferably be located in the handle grip. It is naturally also possible to use a system with a so-called "i-button", in which the RFID reader is activated only when the identification badge is brought into physical contact with a contact surface which is connected to the RFID reader. Such an arrangement draws current only when the RFID reader is activated for reading and is therefore well suited to fitting in the handle grip where the limited space places a limit on the size of the current source that can be used. It is also possible for the control circuit to comprise an RF receiver for remote operation from a remote station, which communicates with the control circuit of the handle device via long-range radio waves.

In the embodiments described above the solenoid for powering the activating member is located in the handle grip, which is to have the facility for disengagement from and coupling to another part of the device. Since the activating member moves axially, however, it is easy to control the activating member with an electrical or mechanical device which is arranged, for example, in a handle grip, a knob or some other element which is fixed to the opposite side of the door on which the handle device is arranged. The axial activation movement means that it is easy, by means of an axially displaceable through-member, such as bar or a shank that is centrally received in the handle spindle, to operate the activating member from either side of the door.

In an embodiment not shown, one or more engaging members, instead of being designed as balls, may consist of an elongate pin, which is arranged parallel to the direction of movement of the activating member and which preferably has a radial, outwardly curved surface and conically tapering ends. One or more such pins may be located in corresponding recesses in the inner coupling member and like the ball may be acted upon by an axially moveable activating member, which is accommodated in the inner coupling member.

The invention claimed is:

1. A handle device for operating structures that may be opened and closed, comprising:

a first element which is rotatable about an axis of rotation, a second element, and a coupling device which is connected to the first and the second element and is designed to at least one of selectively allow or prevent relative rotation about the axis of rotation between the first and the second element, wherein the coupling device further comprises: comprising an outer coupling member, and an inner coupling member, which is concentrically accommodated by the outer coupling member, rotatable about the axis of rotation, in the outer coupling member, characterized by at least one engaging member which is radially displaceable in the inner coupling member, and an activating member which is concentrically accommodated in the inner coupling member and axially displaceable therein, parallel to the axis of rotation, wherein the at least one engaging member and the activating member having interacting contact surfaces in order, during axial displacement of the activating member, to press the engaging member into a radially outwardly projecting position for simultaneous engagement with the inner and outer coupling member.

2. A handle device according to claim 1, wherein the at least one engaging member comprises a ball, which is received in a radial cylindrical hole in the inner coupling member.

3. A handle device according to claim 1, wherein the at least one engaging member comprises an elongated pin, which is arranged parallel to the axis of rotation in a recess in the inner coupling member.

4. A handle device according to claim 3, wherein the elongated pin comprises a circular cylindrical body and conically tapering ends.

5. A handle device according to claim 1, wherein the outer coupling member has a substantially circular cylindrical bore, in which the inner coupling member is received and in the circumferential surface of which a radially curved and axially elongated groove is arranged.

6. A handle device according to claim 1, wherein the first element is a handle grip, which is fixed to the inner coupling member, and the second element is a handle escutcheon, which is fixed to the outer coupling member.

7. A handle device according to claim 1, wherein the first element is a handle grip, which is fixed to the outer coupling element, and the second element is a rotatable swivel pin, which is fixed to the inner coupling member.

8. A handle device according to claim 1, wherein the activating member has a surface, inclined in its axial displacement direction, which in contact with the at least one engaging member presses the engaging member radially outwards when the activating member is displaced axially.

9. A handle device according to claim 1, comprising means for manually acting upon the activating member.

10. A handle device according to claim 1, comprising means for electrically acting upon the activating member.

11. A handle device according to claim 10, comprising a solenoid, which is designed to bring about axial displacement of the activating member.

12. A handle device according to claim 10, comprising an electrical control circuit for controlling the means for electrically acting upon the activating member and authorization-verifying means, which is electrically connected to the control circuit.

13. A handle device according to claim 12 wherein the authorization-verifying means is a keypad.

14. A handle device according to claim 1 wherein the first element is a handle grip coupled to the inner coupling member and the second element is a handle escutcheon that is integral with the outer coupling member.

15. A handle device according to claim 1 wherein the first element is a handle grip that is integral with the outer coupling element and the second element is a rotatable swivel pin that is integral with the inner coupling element.

* * * * *